US005511924A

United States Patent [19]

Liang

[11] Patent Number: 5,511,924

[45] Date of Patent: Apr. 30, 1996

[54] TWO-STORY PARKING APPARATUS WITH ADJUSTABLE RAMP ANGLE

[76] Inventor: Houng-Mou Liang, c/o Hung Hsing Patent Service Center P.O. Box 55-1670, Taipee (104), Taiwan

[21] Appl. No.: 178,833

[22] Filed: Jan. 7, 1994

[51] Int. Cl.[6] ..... E04H 6/06

[52] U.S. Cl. ..... 414/229; 414/230

[58] Field of Search ..... 414/228, 229, 414/230; 410/13, 24, 26

[56] References Cited

U.S. PATENT DOCUMENTS

| | | | |
|---|---|---|---|
| 3,941,257 | 3/1976 | Matsuura | 414/229 |
| 4,892,452 | 1/1990 | Moynihan | 414/229 |
| 5,145,304 | 9/1992 | Rosen | 414/228 |

FOREIGN PATENT DOCUMENTS

| | | | |
|---|---|---|---|
| 2028564 | 12/1971 | Germany | 414/229 |
| 5125849 | 5/1993 | Japan | 414/229 |

*Primary Examiner*—Andres Kashnikow
*Assistant Examiner*—Thomas J. Brahan

[57] ABSTRACT

A two-story parking apparatus includes: a supporting frame, an upper platform pivotally mounted by a shaft on an upper portion of the supporting frame, a tilting device operatively forwarding the upper platform to bias the upper platform about the shaft for tilting the upper platform for providing an inclined ramp adapted for a downwardly removing of an upper car from the upper platform towards a ground floor or for an upward parking of the upper car through the inclined ramp from the floor to be loaded on the upper platform, a restoring device for retracting the upper platform to be normally horizontally held on the supporting frame, and a drag device secured to a rear portion of the upper platform for simultaneously rearwardly pulling a lower platform on which a lower car is parked to prevent damage of the lower car by the inclined upper platform.

8 Claims, 9 Drawing Sheets

TWO-STORY PARKING APPARATUS WITH ADJUSTABLE RAMP ANGLE

BACKGROUND OF THE INVENTION

A conventional parking device as shown in FIGS. 11 and 12 disclosed a platform P slidably vertically adjusted on a frame FM as driven by a driving motor DM or other driving systems for loading an upper car U on the platform to be positioned above a lower car L parking on a base floor G. However, when it is intended to descend the upper car U to the ground floor F, the lower car L should be first moved away from its original parking location to thereby cause inconvenience for a car driver especially for the upper car U.

It is therefore invented by the present inventor a two-story parking device by which the upper car can be directly driven upwardly or downwardly without concerning whether a lower car is parked under the upper car or not.

Summary of the Invention

The object of the present invention is to provide a two-story parking apparatus including: a supporting frame, an upper platform pivotally mounted by a shaft on an upper portion of the supporting frame, a tilting device operatively forwarding the upper platform to bias the upper platform about the shaft for tilting the upper platform for providing an inclined ramp adapted for a downwardly removing of an upper car from the upper platform towards a ground floor or for an upward parking of the upper car through the inclined ramp from the floor to be loaded on the upper platform, a restoring device for retracting the upper platform to be normally horizontally held on the supporting frame, and a drag device secured to a rear portion of the upper platform for simultaneously rearwardly pulling a lower platform on which a lower car is parked to prevent damage of the lower car by; the inclined upper platform.

DETAILED DESCRIPTION

Figure 1:
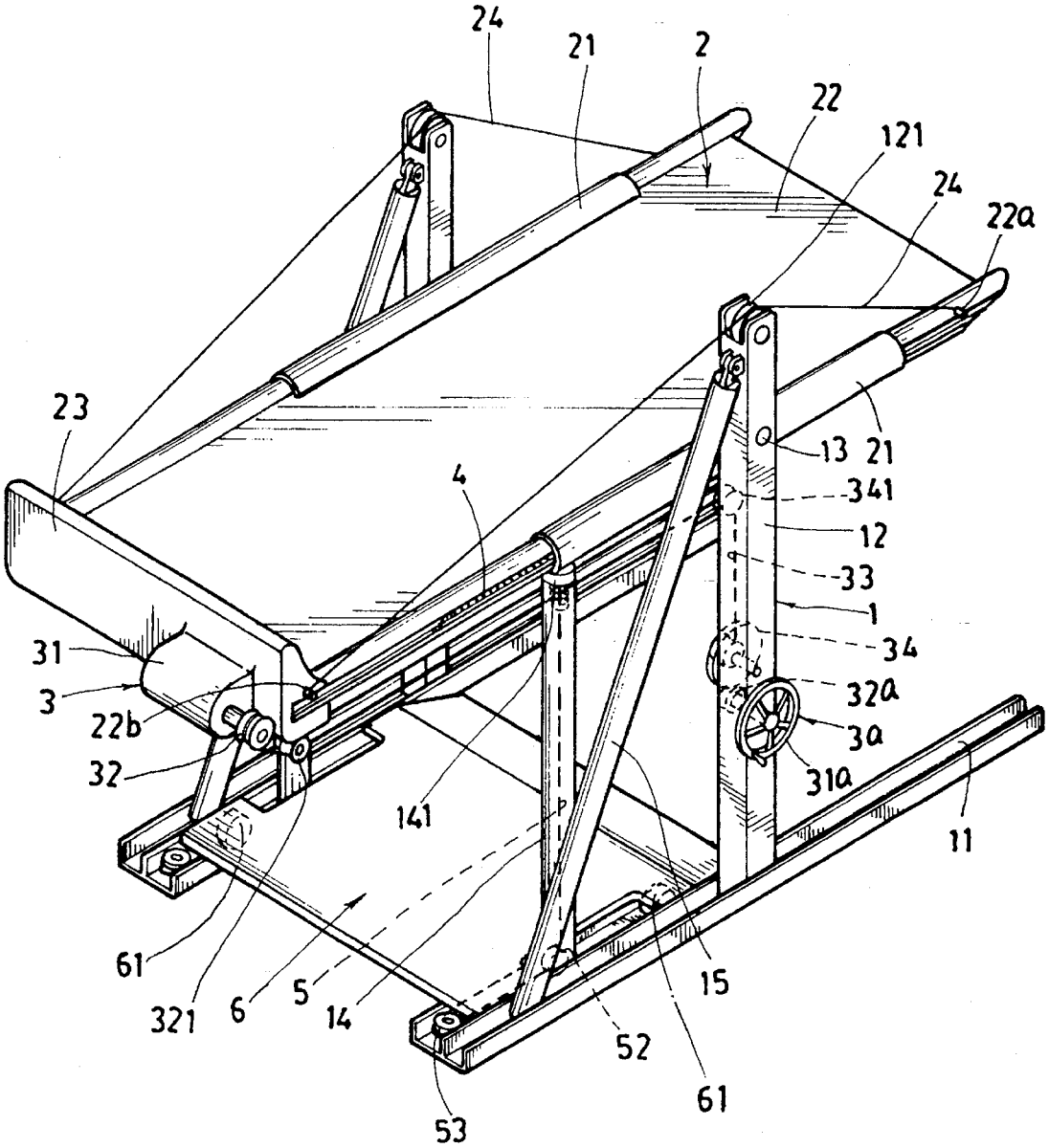
FIG. 1 is a perspective view of the present invention.
Figure 2:
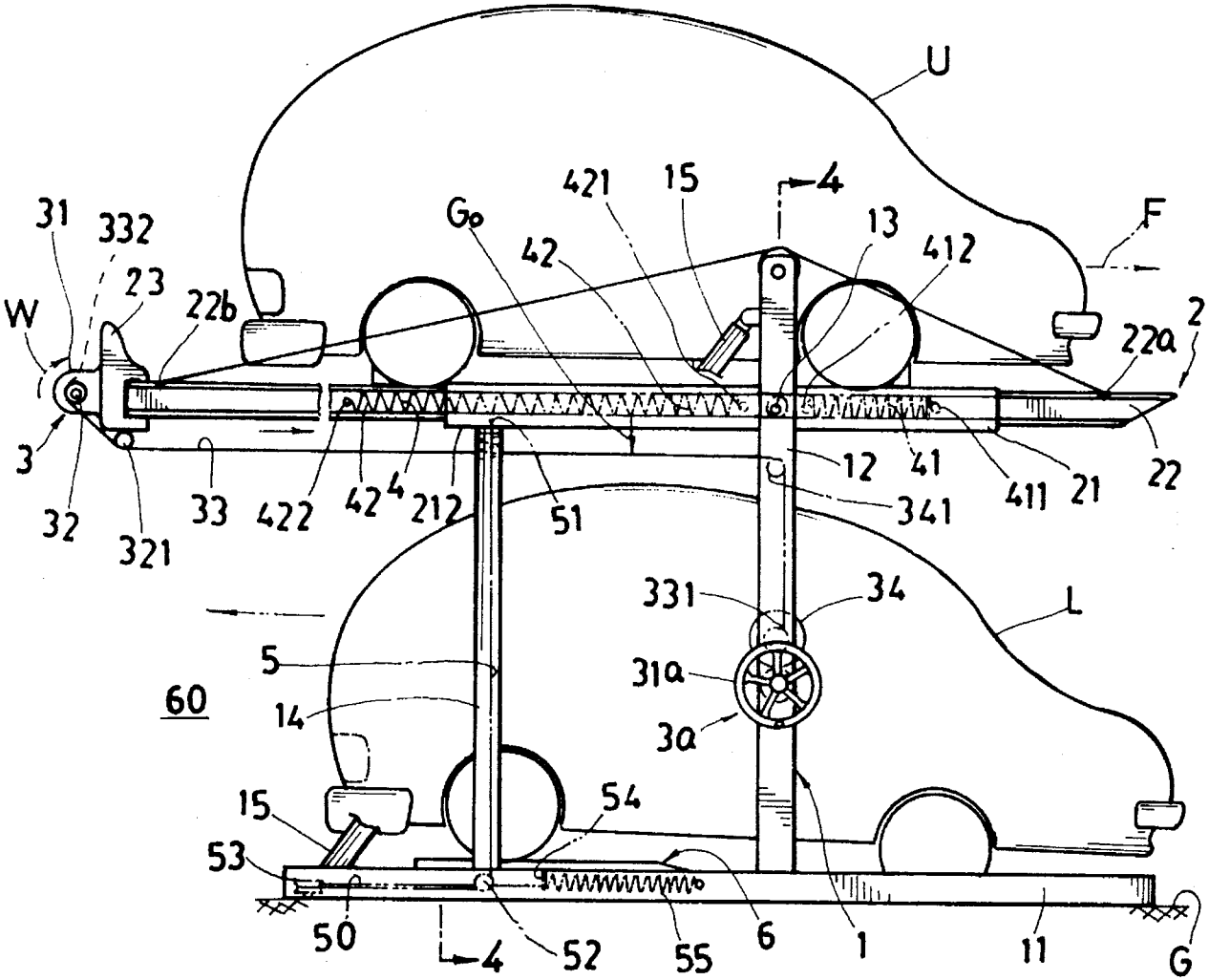
FIG. 2 is an illustration showing two cars respectively parked on an upper and a lower platform of the present invention.

As shown in FIGS. 1–6, the present invention comprises: a supporting frame 1, an upper parking means 2, a tilting means 3, a restoring means 4, a drag means 5, and a lower platform 6. A space 60 defined between the upper parking means 2 and the lower platform 6 is provided for parking a lower car L positioned under an upper car U loaded on the upper parking means 2.

The supporting frame 1 includes: a base 11 which may be a pair of supporting base portions as shown in FIG. 1 or other modifications, a pair of central columns 12 juxtapositionally vertically mounted on the base 11 for pivotally mounting the upper parking means 2 on an upper portion of each central column 12 by a shaft 13, a pair of rear columns 14 juxtapositionally vertically mounted on a rear portion of the base 11 for cooperatively supporting a rear portion of the upper parking means 2, and a pair of reinforcing supporting rods 15 each reinforcing supporting rod 15 secured between an upper portion of each central column 12 and the base 11.

Each rear column 14 may be provided with a shock-absorbing device 141 such as a spring on an upper end of the column 14 for a buffer and shock absorption of the rear portion of the upper parking means 2 when horizontally held on the two rear columns 14 and restored by the restoring means 4.

The upper parking means 2 includes: a pair of sleeve members 21 each sleeve member 21 pivotally secured on an upper portion of each central column 12 by each shaft 13 and each sleeve member 21 having a cross section of C shape or U shape, an upper platform 22 having a pair of I beams 221 with a cross section of I shape each I beam 221 slidably held in each sleeve member 21 and normally restored rearwardly by a restoring means 4 to allow a gravity Go of the upper parking means 2 to be set between each rear column 14 and each central column 12, each sleeve member 21 having a shaft hole 210 pivotally engageable with each shaft 13 for pivotally mounting the sleeve member 21 on the central column 12 and having a rear sleeve portion 212 normally riding on each rear column 14, a rear blocking protrusion 23 protruding upwardly from a rear end of the upper platform 22 for limiting a rearward slipping of an upper car U away from the upper platform 22, and a hanging rope 24 having two rope ends respectively secured to a front and a rear platform portion **22*a*, 22*b* of the upper platform 22 and having a central rope portion slidably hanged on a hanging roller 121 rotatably secured on a top portion of each central column 12**.

Figure 4:
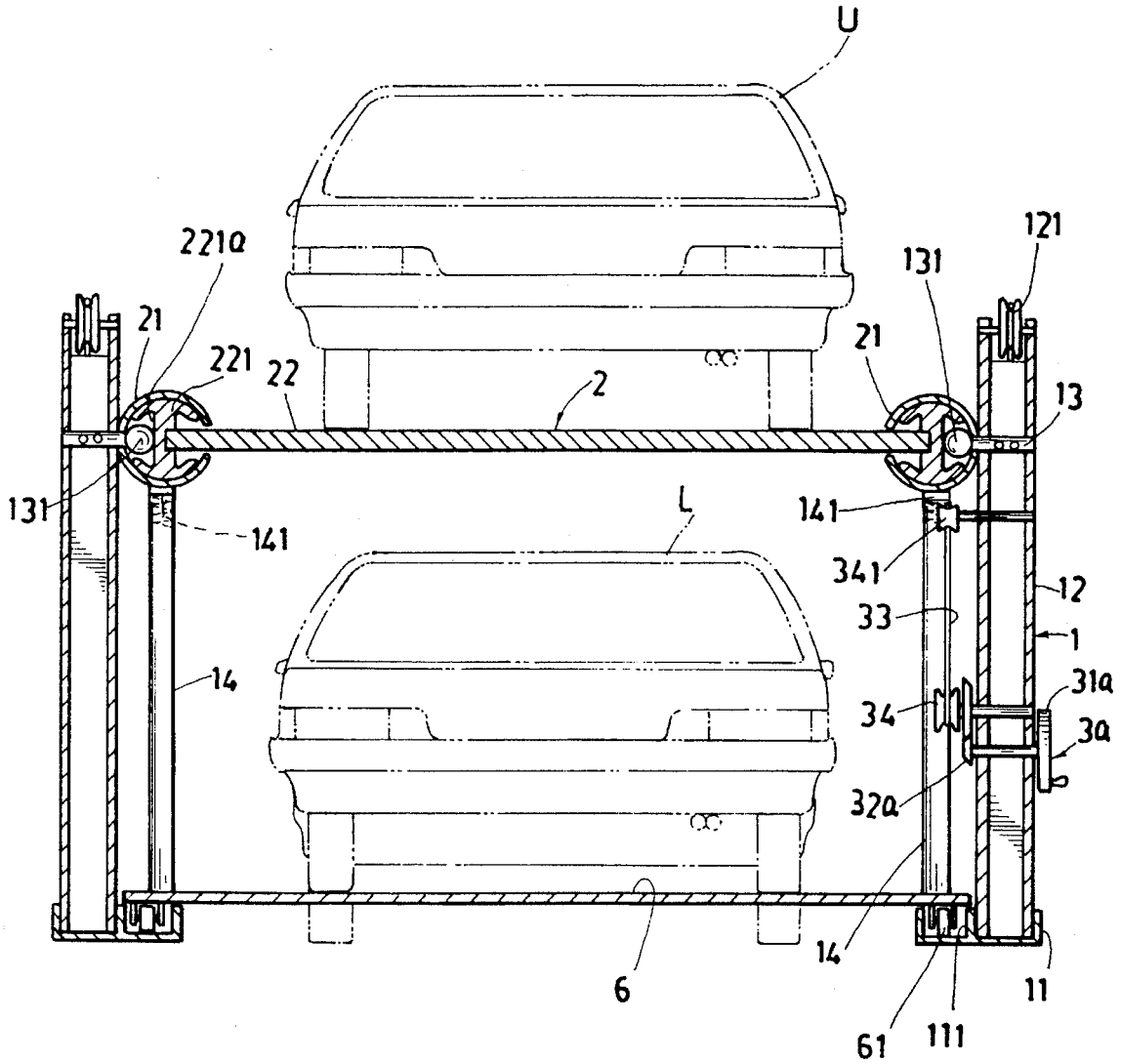
FIG. 4 is a longitudinal sectional drawing of the present invention when viewed from 4—4 direction of FIG. 2.
Figure 5:
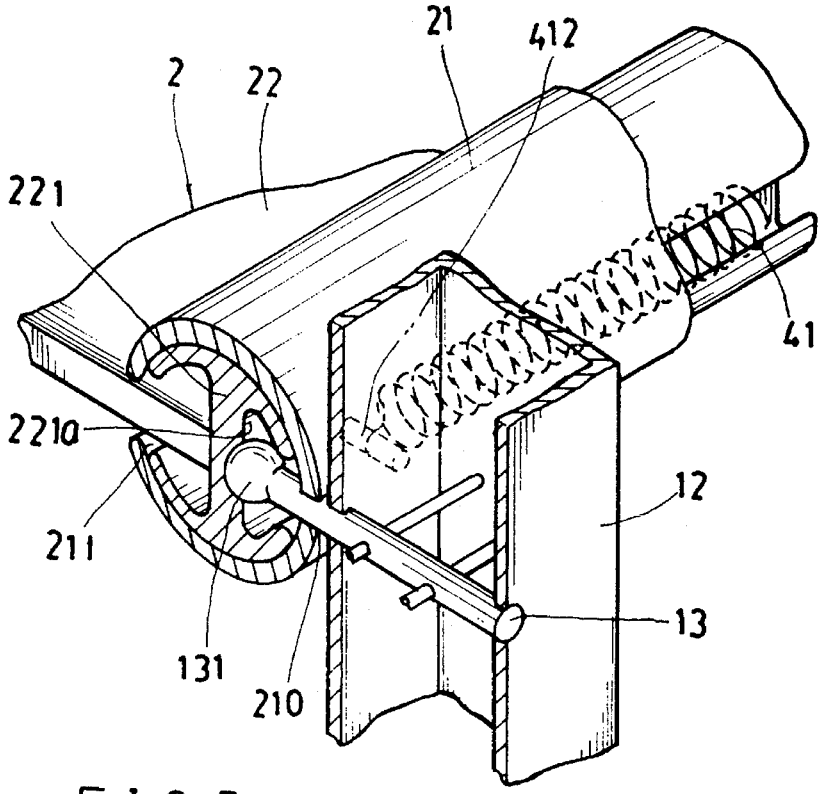
FIG. 5 is a partial illustration showing a pivoting mechanism of the upper platform on the supporting frame.
Figure 6:
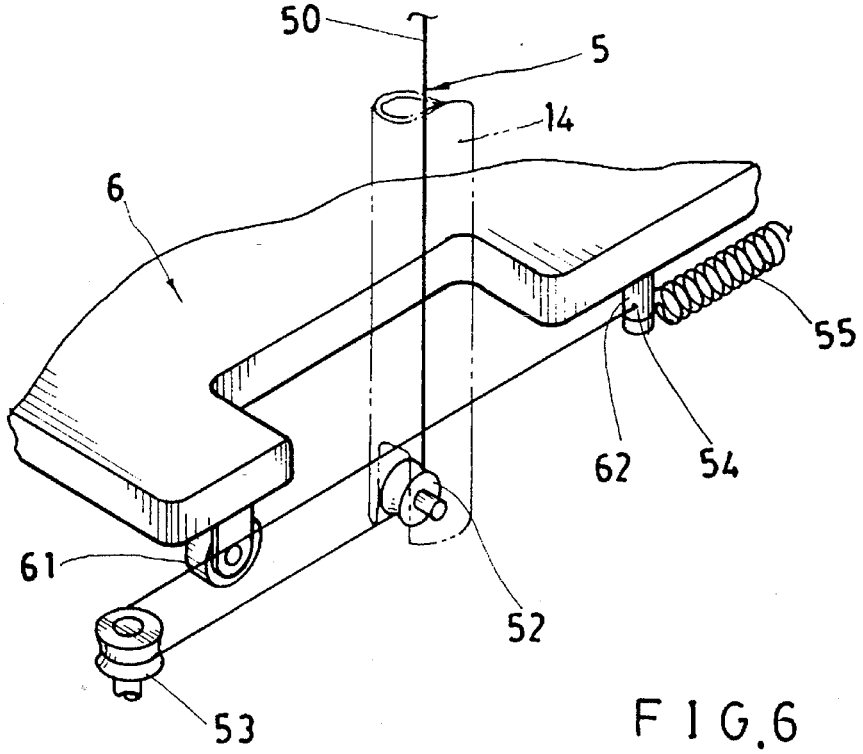
FIG. 6 is a partial illustration showing a drag means of the present invention.

Each shaft 13 has a spherical head portion 131 (which may also be made as other shapes) protruding inwardly from each central column 12 for pivotally limiting each shaft hole 210 formed in each sleeve member 21 and for slidably contacting a vertical wall **221*a* of each I beam 221 as shown in FIG. 4 for dampening a suddenly sliding movement of the I beams 221 in the sleeve members 21** during a tilting and restoring operation.

The tilting means 3 includes: a driving motor 31 secured on a rear end portion of the upper platform 22 having an upper reel 32 connected to a motor shaft f the driving motor 31, a lower reel 34 rotatably mounted on a lower portion of a central column 12 of the supporting frame 1, and an actuating wire 33 having a lower wire end 331 secured to the lower reel 34 and having an upper wire end 332 secured to the upper reel 32, the actuating wire 33 connected between the upper and the lower reels 32, 34 through an upper guiding roller 321 rotatably secured to a rear portion of the upper platform 22 and through a lower guiding roller 341 rotatably secured to an upper portion of the central column 12. The driving motor 31 is operated to wind the actuating wire 33 on the upper reel 32 to shorten a wire length between the upper and lower reels 32, 34 to thereby forward the upper platform for its tilting movement when the upper car forwardly moving for moving a gravity center of the upper platform and the upper car beyond the shaft.

A manual tilting means 3*a* is provided in this invention for manually tilting the upper parking means 2 when a power failure occurs to stop the running of the driving motor 31, including: a driving wheel 31*a* rotatably secured on a lower portion of the central column 12 of the supporting frame 1, and a driving gear set 32*a* rotatably engageable with the driving wheel 31*a* and the lower reel 34 of the tilting means 3.

The restoring means 4 including: at least a first restoring spring 41 which is a tension spring having a front spring end 411 of the first spring 41 secured to a front platform portion 22*a* and a rear spring end 412 of the first spring 41 secured to a central portion of the sleeve member 21, and at least a second restoring spring 42 which is a compression spring having a front spring end 421 of the second spring 42 secured to a central portion of the sleeve member 21 and a rear spring end 422 of the second spring 42 secured to a rear platform portion 22*b* of the upper platform 22.

Figure 3:
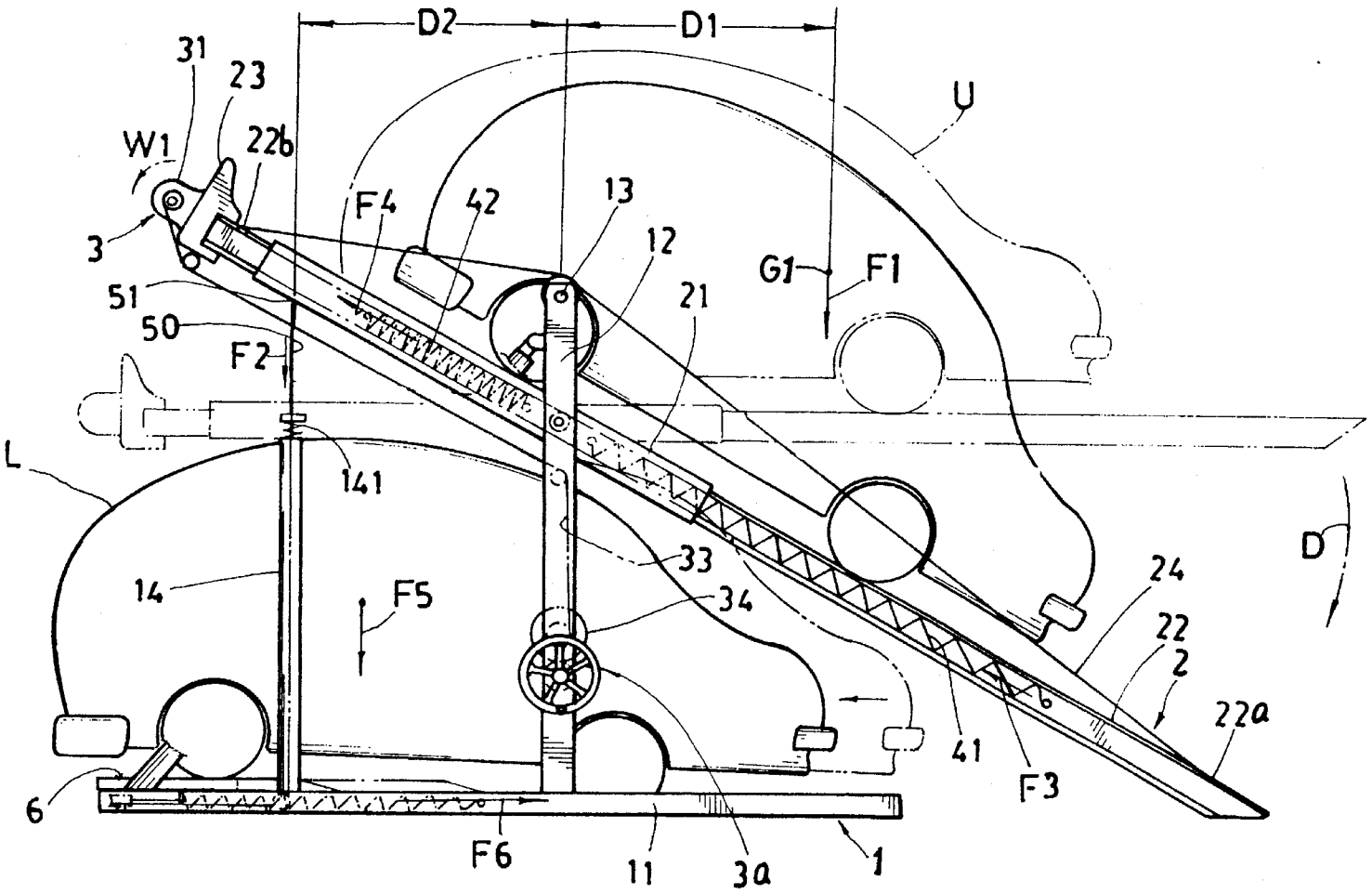
FIG. 3 is an illustration showing a downward driving of the upper car from the upper platform in accordance with the present invention.

The drag means 5 includes: a pulling wire 50 having an upper fixing end 51 secured to a rear portion of a sleeve member 21 of the upper parking means 2 and a lower fixing end 54 secured to a lug 62 of a lower platform 6 having a plurality of wheels 61 rotatably secured to the lower platform 6 for moving the lower platform 6 on the base 11 laid on a ground floor G, a lower restoring spring 55 securing the lug 62 and the lower fixing end 54 of the pulling wire 50 to a central portion of a base 11 of the supporting frame 1, a rearmost roller 53 rotatably secured to a rear end portion of the base 11 for winding the pulling wire 50 through the rearmost roller 53 to be tensioned between the upper fixing end 51 and the lower fixing end 54, and a bottom roller 52 rotatably mounted on a lower portion of a rear column 14 of the supporting frame 1 for guiding the pulling wire 50 between the upper fixing end 51 and the rearmost roller 53, whereby upon a tilting of the upper platform 22 forwardly to raise the rear portion of the sleeve member 21 to pull the pulling wire 50 upwardly, the lower platform 6 will be pulled rearwardly to pull a lower car L rearwardly from a dotted-line state to a solid-line state as shown in FIG. 3 as pulled by the pulling wire 50 through the bottom roller 52, the rearmost roller 53 to prevent damage by downwardly tilting the upper platform 22.

The wheels 61 of the lower platform 6 may be slid in the bottom guiding rails 111 formed in the base 11 of the frame 1 as shown in FIG. 4.

Figure 9:
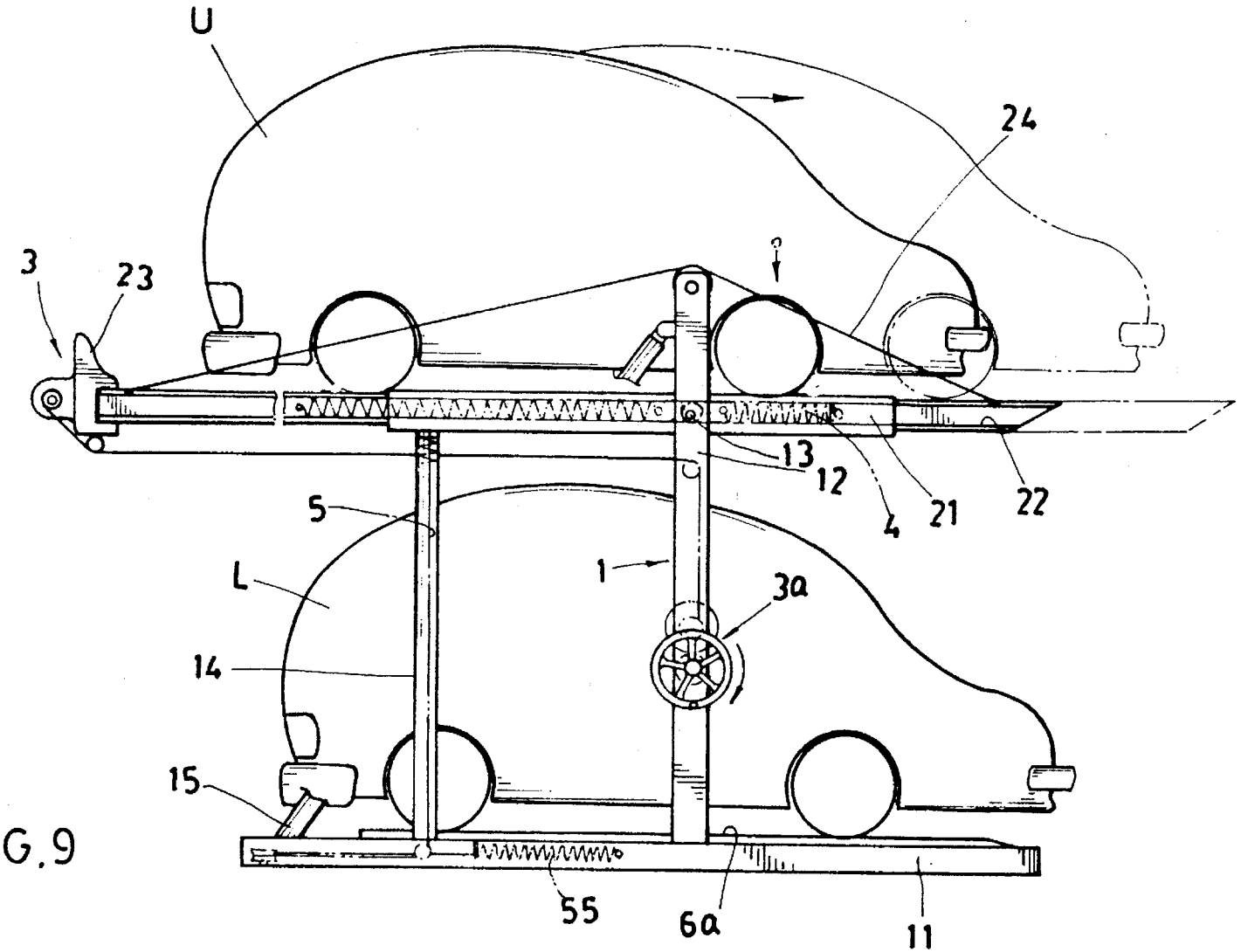
FIG. 9 shows another preferred embodiment of the present invention.
Figure 10:
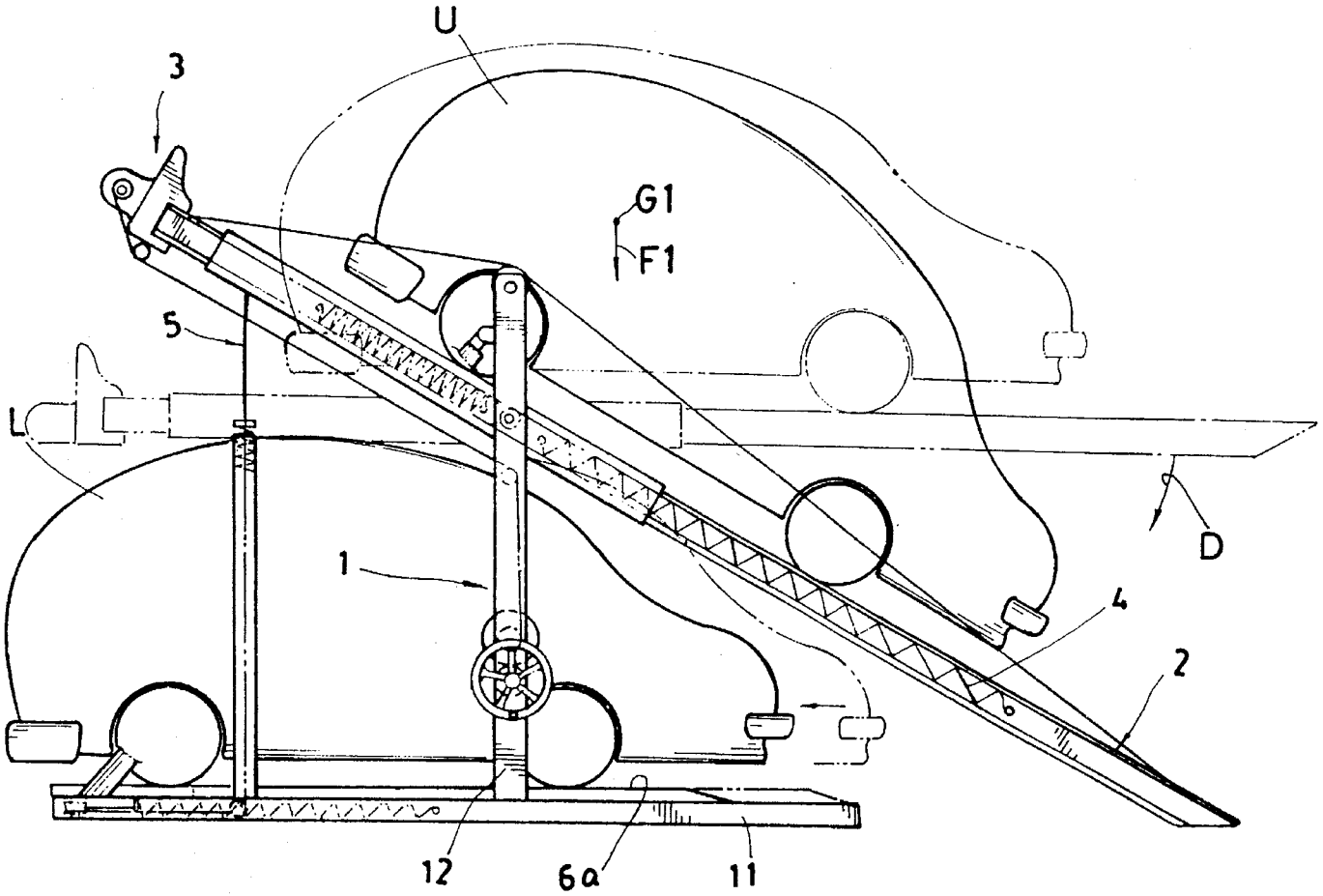
FIG. 10 further shows a downward movement of an upper car and a rearward pulling of a lower car of the present invention by shortening a wire rope between the platform and the frame.
Figure 11:
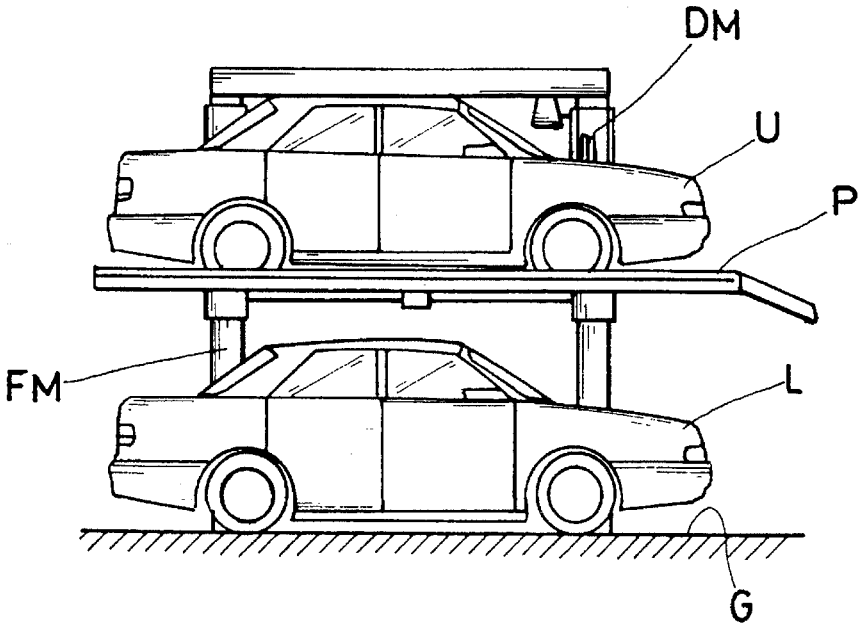
F I G.11 PRIOR ART
FIG. 11 shows a conventional two-story parking device.
Figure 12:
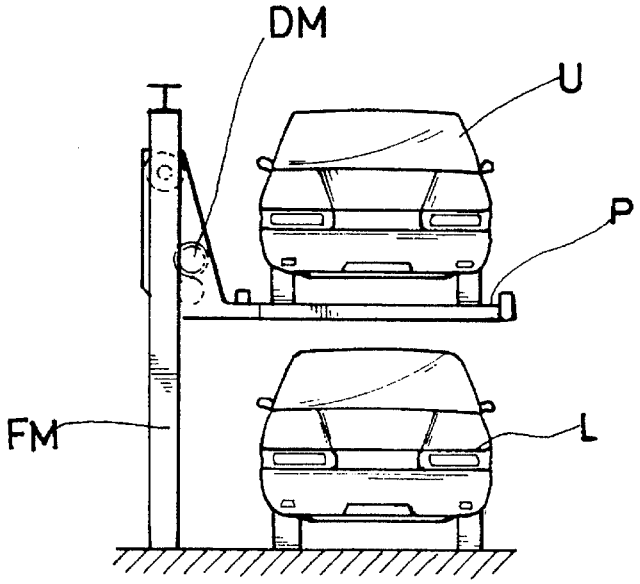
F I G.12 PRIOR ART
FIG. 12 shows another view of the conventional two-story parking device as shown in FIG. 11.

The lower platform 6 may be modified to be an elongated lower platform 6*a* as shown in FIGS. 9, 10 for loading a lower car L of four wheels, no matter whether any wheels are locked by a hand lock. However, either the shorter lower platform 6 as shown in FIGS. 1–6 merely for two rear (or front) wheels of a lower car L or the elongated platform 6a as shown in FIGS. 9, 10 for the full four wheels of the lower car may be used in this invention.

When an upper car U loaded on the upper parking means 2 is driven downwardly, the driving motor 31 of the tilting means 3 is operated to rotate the upper reel 32 in direction W to wind the actuating wire 33 on the upper reel 32 to shorten a wire length tensioned between the upper reel 32 and the lower reel 34 to push the upper platform 22 and the upper car U loaded thereon forwardly as slid in the two sleeve members 21. When the upper car U is forwarded to extend a gravity center G1, a biasing force F1 of a gravitational force of the upper car U plus the weight of the upper parking means 2 to overcomes counter force of a downwardly pulling force F2 by the wire 50, as loaded by the lower car L, as shown in FIG. 3, plus two restoring forces F3, F4 effected by the first and the second restoring springs 41, 42. Thus the upper platform 22 will be tilted forwardly to form a sloping ramp adapted for a downwardly driving of the upper car U to a ground floor G.

If the biasing force F1 is separated from the shaft (pivot) 13 about a distance D1 and the pulling wire end 51 is separated from the shaft 13 with a distance D2 as shown in FIG. 3, a formula can then be obtained as follows:

$$F1 \times D1 > (F2 \times D2) + F3 + F4$$

wherein F2 is a counter force effected by a weight F5 of a lower car L plus a weight of the lower platform 6 and a resilience F6 of the lower restoring spring 55.

Figure 7:
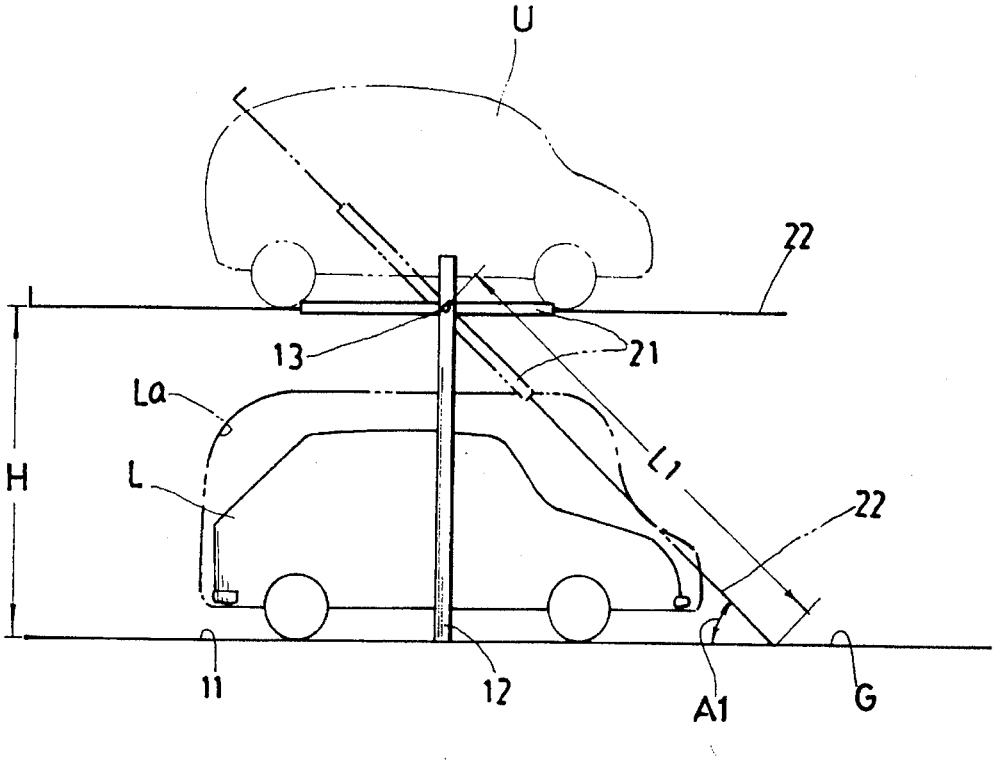
FIG. 7 shows an operation when inclinedly biasing the upper platform for driving an upper car downwardly above a small lower car.
Figure 8:
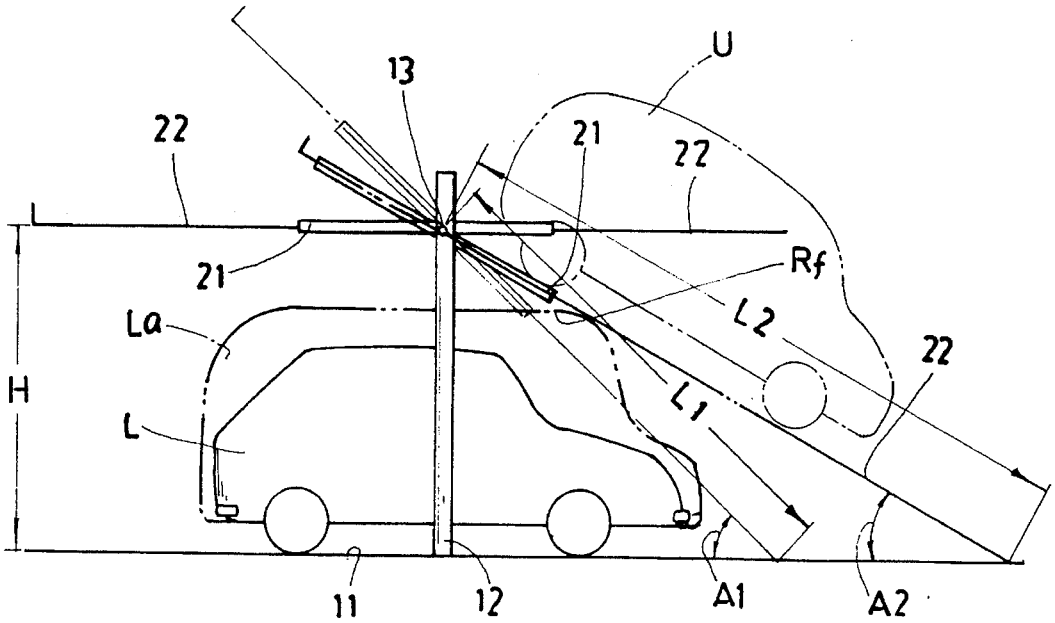
FIG. 8 shows an operation when tilting the upper platform for driving the upper car downwardly over a larger lower car.

For parking a lower car La having a higher roof Rf as shown in FIG. 8, the upper platform 22 can be forwardly moved to produce a longer "ramp distance" L2 which is larger than a distance L1 as shown in FIG. 7 for parking a lower car L of lower roof to prevent damage to the roof Rf of the larger car La parking in the space 60 below the upper parking means 2.

If a shorter ramp distance L1 on the upper platform 22 beyond the fulcrum (shaft) 13 for a small lower car L defines a first sloping angle A1 between the upper platform 22 and the ground floor G as shown in FIG. 7 and the height of the shaft (fulcrum) 13 above the floor G is designated as H, then a formula is obtained:

$$\sin A1 = H/L1$$

While a longer ramp distance L2 defines a second sloping angle A2 between the upper platform 22 and the floor G as shown in FIG. 8, a second formula can then be obtained:

$$\sin A2 = H/L2$$

Since L2 is larger than L1 (L2>L1), the value of SinA2 will be smaller than that of SinA1, indicating that the angle of A2 is smaller than angle A1 to thereby prevent damage to a roof Rf of the lower car La.

When it is intended to downwardly drive a car U from the upper platform 22, the lower car L can be automatically dragged rearwardly without causing damage to the lower car L. Accordingly, this invention provides a safer parking device for two-story parking apparatus.

Some modifications can still be made without departing from the spirit and scope of this invention, such as by adding hydraulic shock absorbing system to prevent serious vibration caused by any sudden impact force when tilting or restoring the upper platform 22, which are not limited in this invention. A control means for braking the operating elements of this invention in some temporary transition states may be provided. For instance, a locking device (not shown) can be provided to temporarily lock the reel 34 or wheel 31*a* when tilting the upper platform 22 for downwardly (or upwardly) driving car thereon.

Although this invention discloses an actuating wire 33 of the tilting means 3 and a pulling wire 50 of the drag means 5, the wire 33 or 50 may be made of steel wire rope or other ropes which are not limited in this invention.

I claim:

1. A two-story parking apparatus comprising: a supporting frame (1), an upper platform 22 slidably held in an upper parking means (2) and pivotally mounted by a shaft (13) on an upper portion of the supporting frame (1) with said upper platform 2 normally horizontally held on said frame (1), a tilting means (3) mounted on said upper parking means (2) and said frame (1) and operatively forwarding the upper platform (22) to forwardly move a gravity center of the upper parking means (2) loaded with an upper car thereon to be positioned in front of the shaft (13) to bias the upper platform (22) about the shaft (13) for downwardly tilting the upper platform (22) for providing an inclined ramp adapted for a downwardly driving of an upper car from the upper platform (22) towards a ground floor or for an upward parking of the upper car through the inclined ramp from the floor to be loaded on the upper platform (22), a restoring means (4) for retracting the upper platform (22) to be horizontally held on the supporting frame (1) when stopping operation of said tilting means (3), and a drag means (5) secured to a rear portion of the upper platform (22) and to a lower platform (6) positioned below said upper parking means (2) for simultaneously rearwardly pulling the lower platform (6) as the upper platform (22) is downwardly tilted to prevent damage to a car parked on the lower platform (6) by the upper platform (22).

2. A parking apparatus according to claim 1, wherein said supporting frame (1) includes: a base (11), a pair of central columns (12) juxtapositionally vertically mounted on the base (11) for pivotally mounting the platform (22) of said upper parking means (2) on an upper portion of each central column (12) by said shaft (13), a pair of rear columns (14) juxtapositionally vertically mounted on a rear portion of the base (11) for cooperatively supporting a rear portion of the upper parking means 12, and a pair of reinforcing supporting rods (15) each reinforcing supporting rod (15) secured between an upper portion of each said central column (12) and the base (11).

3. A parking apparatus according to claim 2, wherein said upper parking means (2) includes: a pair of sleeve members (21) each sleeve member (21) pivotally secured on an upper portion of each said central column (12) by each said shaft (13) and each said sleeve member (21) having a cross section of C shape, said upper platform 22 having a pair of I beams (221) with a cross section of I shape each I beam (221) slidably held in each said sleeve member (21) and normally restored rearwardly by a restoring means (4) to allow a gravity (Go) of the upper parking means (2) to be set between each said rear column (14) and each said central column (12), each said sleeve member (21) having a shaft hole (210) pivotally engageable with each said shaft (13) for pivotally mounting the sleeve member (21) on the central column (12) and having a rear sleeve portion (212) normally riding on each said rear column (14), a rear blocking protrusion (23) protruding upwardly from a rear end of the upper platform (22) for limiting a rearward slipping of an upper car (U) away from the upper platform (22), and a hanging rope (24) having two rope ends respectively secured to a front and a rear platform portion (22*a*, 22*b*) of the upper platform (22) and having a central rope portion slidably hanged on a hanging roller (121) rotatably secured on a top portion of each said central column (12) for auxiliarily suspending the I beams on the frame (1).

4. A parking apparatus according to claim 3, wherein each said shaft (13) has a spherical head portion (131) protruding inwardly from each said central column (12) for pivotally limiting each said shaft hole (210) formed in each said sleeve member (21) and for slidably contacting a vertical wall (221*a*) of each said I beam (221) for dampening sliding movements of the I beams (221) in the sleeve members 21 during a tilting and restoring operation.

5. A parking apparatus according to claim 3, wherein said restoring means (4) including: at least a first restoring spring (41) which is a tension spring having a front spring end (411) of the first spring (41) secured to a front platform portion (22*a*) and a rear spring end (412) of the first spring (41) secured to a central portion of the sleeve member (21), and at least a second restoring spring (42) which is a compression spring having a front spring end (421) of the second spring (42) secured to a central portion of the sleeve member (21) and a rear spring end (422) of the second spring (42) secured to a rear platform portion (22*b*) of the upper platform (22).

6. A parking apparatus according to claim 1, wherein said tilting means (3) includes: a driving motor (31) secured on a rear end portion of the upper platform (22) having an upper reel (22) connected to a motor shaft of the driving motor (31), a lower reel (34) rotatably mounted on a lower portion of a central column (12) of the supporting frame (1), and an actuating wire (33) having a lower wire end (331) secured to the lower reel (34) and having an upper wire end (332) secured to an upper reel (32), the actuating wire (33) connected between the upper and the lower reels (32, 34) through an upper guiding roller (321) rotatably secured to a rear portion of the upper platform (22) and through a lower guiding roller (341) rotatably secured to an upper portion of the central column (12), said driving motor (31) operatively winding the actuating wire (33) on the upper reel (32) to shorten a wire length between the upper and lower reels (32, 34) to thereby forward the upper platform (22) for a tilting of said platform (22).

7. A parking apparatus according to claim 6, wherein a manual tilting means (3*a*) is provided for manually tilting the upper parking means (2) when a power failure occurs to stop the running of the driving motor (31), said manual tilting means (3*a*) including: a driving wheel (31*a*) rotatably secured on a lower portion of the central column (12) of the supporting frame (1), and a driving gear set (32*a*) rotatably engageable with the driving wheel (31*a*) and the lower reel (34) of the tilting means (3).

8. A parking apparatus according to claim 1, wherein said drag means (5) includes: a pulling wire (50) having an upper fixing end (51) secured to a rear portion of a sleeve member (21) of the upper parking means (2) and a lower fixing end (54) secured to a lug (62) of a lower platform (6) having a plurality of wheels (61) rotatably secured to the lower platform (6) for moving the lower platform (6) on the base (11) laid on a ground floor (G), a lower restoring spring (55) securing the lug (62) and the lower fixing end (54) of the pulling wire (50) to a central portion of a base (11) of the supporting frame (1), a rearmost roller (53) rotatably secured to a rear end portion of the base (11) for winding the pulling wire (50) through the rearmost roller (53) to be tensioned between the upper fixing end (51) and the lower fixing end (54) of said pulling wire (50), and a bottom roller (52) rotatably mounted on a lower portion of a rear column (14) of the supporting frame (1) for guiding the pulling wire (50) between the upper fixing end (51) and the rearmost roller (53), whereby upon tilting of the upper platform (22) forwardly to raise the rear portion of the sleeve member (21) to pull the pulling wire (50) upwardly, the lower platform (6) will be pulled rearwardly to pull a lower car (L) rearwardly as pulled by the pulling wire (50) through the bottom roller (52), the rearmost roller (53) to prevent damage of the lower car by downwardly tilting the upper platform (22).

* * * * *